US006866248B1

(12) United States Patent
Sears

(10) Patent No.: US 6,866,248 B1
(45) Date of Patent: Mar. 15, 2005

(54) POST EXTRACTING DEVICE

(76) Inventor: Michael R. Sears, 1701 Crystal Way, Plano, TX (US) 75075-4203

( * ) Notice: Subject to any disclaimer, the term of this patent is extended or adjusted under 35 U.S.C. 154(b) by 0 days.

(21) Appl. No.: 10/292,944

(22) Filed: Nov. 13, 2002

Related U.S. Application Data

(60) Provisional application No. 60/347,009, filed on Jan. 10, 2002.

(51) Int. Cl.[7] ..... E21B 19/00
(52) U.S. Cl. ..... 254/30
(58) Field of Search ..... 254/132, 30, 31, 254/29 R

(56) References Cited

U.S. PATENT DOCUMENTS 2,757,903 A * 8/1956 Bill ..... 254/30
3,734,463 A * 5/1973 Enright ..... 254/30

* cited by examiner

*Primary Examiner*—Robert C. Watson
(74) *Attorney, Agent, or Firm*—Harrison & Egbert

(57) ABSTRACT

A post extracting device having a frame, a ram supported on the frame with a piston extending outwardly therefrom, and a chain affixed to the piston. The ram serves to move the piston from a retracted position to an extended position. The chain is suitable for wrapping around the post. The ram pushes the chain upwardly so as to extract the post from the earth. The ram is pivotally mounted to the frame so as to be movable between a vertical orientation to an orientation angularly offset from vertical.

15 Claims, 4 Drawing Sheets

POST EXTRACTING DEVICE

RELATED U.S. APPLICATIONS

The present utility patent applicant claims priority from U.S. Provisional Application No. 60/347,009, filed on Jan. 10, 2002 and entitled "FENCE POST EXTRACTOR", presently pending.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to devices for extracting posts from the earth. More particularly, the present invention relates to small portable devices which can grasp posts for the purpose of pulling the posts from the earth.

BACKGROUND OF THE INVENTION

Several devices are supported by one or more posts driven into the earth. Such device includes signs, mail boxes, fences and the like. The post may be a one-piece post with a load carrying portion driven directly into the ground, or a two-piece post with a post anchor driven into the ground and the upper or load carrying portion of the post being driven or bolted to the post anchor. As used herein, the term "post" can be used to refer to either the one-piece or the two-piece assembly, and to either a post or post anchor. From time to time it may be necessary to remove or relocate the post. At that time, it also becomes necessary to remove post or the post anchor. The post anchor can be poured concrete in a hole in which the post is placed.

It is sometimes possible to remove the post manually. This process is labor intensive, and may require striking the post from several different direction with a sledge hammer to loosen the ground about the post and then leaning over and grabbing the post and yanking the post of the ground or digging up the post and its anchor. Not only is the process labor intensive, but the post may become damaged so that it cannot be reused, and the laborer can sustain back injuries in the process.

A variety of patents have issued relating to such post pullers. For example, U.S. Pat. No. 6,398,188 issued on Jun. 4, 2002 to M. T. Salman, describes a post puller with an H-shaped base and a pair of parallel legs and a cross beam extending perpendicular to the legs. A pair of single-action hydraulic cylinders are mounted to the cross beam so as to straddle the post to be pulled. The cross member is pivotally mounted to each cylinder rod. A chain is suspended from the mid-point of the cross member. The chain can be wrapped around the post, or the post-gripping structure can be attached to the free end of the chain. A pair of wheels may be mounted to the base for portability.

U.S. Pat. No. 6,367,779 issued on Apr. 9, 2002 to Martin et al., describes a post pulling mechanism having a lever extendable for increasing the leverage for pulling the post from the ground. The lever is securable within a base and has a handle suitable for grasping by the operator. A chain extends downwardly from a chain-engaging front portion of the lever. A post holder mechanism is carried at the bottom of the chain.

U.S. Pat. No. 6,382,594 issued on May 7, 2002 to D. L. Ransom, also describes a post puller adapted to be mounted on a vehicle. A base member is provided having a post-receiving recess so as to receive the post from a side thereof. A pair of cylinders are provided in cooperative relationship with the post holder so as to urge the post from the ground.

U.S. Pat. No. 5,054,744, issued on Oct. 8, 1991 to J. D. Essex, describes a pulling device for removing ground-embedded structures. This pulling device includes a leverage mechanism which provides pull and lift by the manipulation of a chain. A force application mechanism provides a variable torque for the removal of the ground-embedded structure.

U.S. Pat. No. 5,186,437, issued on Feb. 16, 1993 to T. P. Scott, describes a post puller for post with concrete bases. The post puller includes a fulcrum, a pair of upright arms extending from the base and pivot pin of circular cross section attached between the arms remote from the base, and a lever of circular cross section in pivoting contact with the fulcrum when the wooden post is extracted.

U.S. Pat. No. 5,211,374, issued on May 18, 1993 to Head et al., also describes a post puller having a pair of wheels that can be used in combination with a tractor or other mechanical devices. A pair of gripper blades are arranged in a V-shaped pattern and are pivotally attached to a pyramidical structure. When the post is gripped by the gripper blades, the lifting of the base frame causes the gripper blades to pivot downwardly into the post.

U.S. Pat. No. 5,368,277 issued on Nov. 29, 1994 to F. Moss, teaches a device for removing metal fence posts. A bracket engages the edge of the web of the fence post. A clevis is placed over the fence post so as to engage the front face of the fence post. A ring is provided to receive the pulling force such that when the ring is pulled upwardly, the portion of the clevis proximate to the face of the fence post is pulled inwardly toward the fence post while at the same time a brace is also pulled toward the fence post.

U.S. Pat. No. 4,161,310, issued on Jul. 17, 1979 to M. D. Parker, describes a metal fence post puller which is manually operable. An elongated bar is affixed at one end thereof to one end of a shaft-like support member. A base plate is attached to the opposite end of the support member so as to be positioned adjacent to the metal post. An opposite end of the elongated bar is secured to the post so that a pivoting action by the elongated bar can remove the fence post.

U.S. Pat. No. 4,750,711, issued on Jun. 14, 1988 to R. J. Landry, also describes a post puller having a structure supported on a pair of wheels. The forward end of this structure has a gripping mechanism that can engage the fence post. An opposite end of the structure can be suitably secured to a winch, or to a vehicle so as to pivot the wheels for the purpose of lifting the fence post from the earth.

U.S. Pat. No. 4,846,445, issued on Jul. 11, 1989 to W. W. Pfeffer, teaches a hydraulic fence post puller for use in conjunction with a tractor, backhoe or other piece of mobile equipment. The device relies upon self-clamping jaws which engage the fence post so that hydraulic mechanisms can carry out an action for the lifting of the fence post from the earth.

U.S. Pat. No. 5,464,192, issued on Nov. 7, 1995 to D. A. Burnham, describes a manual post puller having a lever arm with multiple pivot points and a fulcrum mounted on a force-dispersing foot. The cinch for the post is mounted on the end of the lever arm. A downward force on the lever arm will cause a lifting force on the post.

U.S. Pat. No. 5,499,795, issued on Mar. 19, 1996 to M. L. Mathews, also describes a post pulling device having a vertical support member attached to a base plate and having an elongated telescoping handle connected to a C-shaped head portion. The head portion engages the post so that a downward pivoting action on the handle will cause a lifting force to be applied to the post.

U.S. Pat. No. 5,597,151, issued on Jan. 28, 1997 to C. W. Duncan, also describes a stake pulling device which utilizes a lever and a fulcrum for mechanical advantage. A stake is positioned between a blade affixed to the end of the lever and a back plate pivotally attached to the blade. When the user pivots the lever downwardly, the stake is pinched between the forward edge of the blade and the primary surface of the back plate.

U.S. Pat. No. 5,604,946, issued on Feb. 25, 1997 to W. W. Stenerson, teaches a multipurpose fence building tool which includes an elongated member having a slidably adjustable flange suitable for fixing onto the earth. A chain is supported at the top of the elongated member and can be wrapped around the fence post. If required, a downward force on the chain will pivot the elongated member for the purpose of providing a mechanical advantage for lifting the fence post out of the earth.

U.S. Pat. No. 5,713,559, issued on Feb. 3, 1998 to McClarin, describes a post removal device with at least two base support plates for a fulcrum lever to pull the post at a suitable angle from the earth. A jaw is suitable for connecting to the fence post. The jaw is a diamond-shaped member for grasping the fence post in four places. Jacks can be provided for providing the lifting force.

U.S. Pat. No. 5,794,918, issued on Aug. 18, 1998 to M. G. Price, describes a fence post pulling device in which a fulcrum stand has an action lever movably connected at one end. A receiving box supports a gripping pawl for connection to the post. A movement of the action lever will cause the suitable leverage for the lifting of the fence post from the earth.

U.S. Pat. No. 6,131,884, issued on Oct. 17, 2000 to Broussard et al., describes a tool for the extraction of stakes. The tool includes a vertical support attached to a base, a lever arm, a stake engaging head, and elongated connecting member connecting the head with the lever arm. The connecting member can be positioned at different locations on the shorter lever so as to provide differing leverage options for the user.

U.S. Pat. No. 6,302,377, issued on Oct. 16, 2001 to M. Pimental, also describes a post pulling apparatus having a base assembly with a base member and having a plurality of wheel members securely mounted to the base member. An elongated support member is vertically disposed upon the base member and has an open top end and a bore extending therethough. The device also includes a post pulling assembly for pulling the post out of the ground.

U.S. Design Pat. No. 372,177, issued on Jun. 30, 1996 to S. C. Hansen, and U.S. Design Pat. No. 361,248 issued on Aug. 15, 1995 to Harper et al., are each designs showing different configurations of post pulling devices.

It is an object of the present invention to provide a fence post extractor which is easily portable and transportable.

It is an object of the present invention to provide fence post extractor which can be effectively manipulated for providing maximum mechanical advantage for the extractions of post.

It is a further object of the present invention to provide a fence post extractor that can be easily used without external mechanical equipment.

It is a further object of the present invention to provide a fence post extractor which can be manipulated for storage or for use.

It is still a further object of the present invention to provide a fence post extractor which is easy to use, relatively inexpensive, and easy to manufacture.

These and other objects and advantages of the present invention will become apparent from a reading of the attached specification and appended claims.

BRIEF SUMMARY OF THE INVENTION

The present invention is a post extracting device comprising of a frame, a ram means pivotally mounted on the frame and having a piston extending outwardly therefrom, and a post gripping means affixed to the piston. The post gripping means serves to wrap around the post. The ram means pushes the post gripping means upwardly so as to extract the post from the earth. The ram means move the piston from a retracted position to an extended position.

The ram means is pivotally mounted on the frame so as to be movable between a vertical orientation to a position angularly offset from vertical orientation. In particular, the ram means includes a cylinder having a bottom affixed to the frame. The piston extends outwardly of a top of the cylinder. The post gripping means is affixed to the top of the piston. A pneumatic actuator is connected to the cylinder so as to move the piston from the retracted position to the outwardly extending position. As used herein, the "post gripping means" can be a chain, a cable, a strap or a metal band.

In the present invention, the frame comprises an I-beam structure having side plates in a central area, and a plate rotatably mounted to the side plates. The ram means is affixed to these plates. This I-beam structure is an angled forward surface. The plate is rotatable upon the angled forward surface so as to allow the ram means to tilt outwardly from the frame. A cleat is affixed to the forward edge of the angled forward surface. The cleat has a bottom earth-engaging edge. The I-beam structure has a stop member positioned in the central area thereof so as to support the plate in the vertical orientation. A handle is affixed to a rear of the I-beam structure. This handle extends upwardly therefrom. An axle is affixed to the handle toward the rear of the I-beam structure. A pair of wheels are rotatably mounted respectively on opposite ends of the axle.

This piston includes a cross bar extending transversely thereacross. The post gripping means also includes a hook affixed to one end of the cross bar such that the chain of the post gripping means has one end affixed to the end of the cross bar and opposite end secured to the hook.

The present invention is also a method of extracting a post from the earth comprising the steps of: (1) positioning a ram adjacent to a surface of the post; (2) wrapping the flexible member around the post; (3) securing flexible members to the piston; (4) actuating the ram so as to forcibly push the postin outwardly of the cylinder; and (5) pulling the post outwardly of the earth as the piston pushes the chain and the post upwardly. The method of the present invention can also include the step of tilting the ram to an angle offset from vertical prior to the step of actuating.

DETAILED DESCRIPTION OF THE INVENTION

Figure 1:
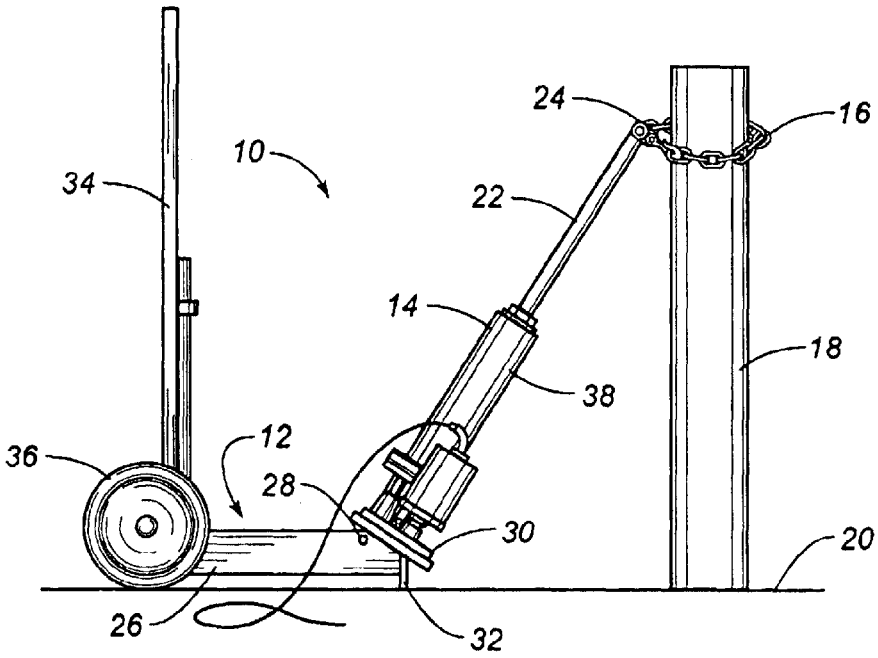
FIG. 1 is a side elevational view showing the operation of the fence post extractor in accordance with the preferred embodiment of the present invention.

Referring to FIG. 1, the post extracting device 10 is shown in accordance with the teachings of the preferred embodiment of the present invention. The device 10 includes a frame 12, a ram 14 and a chain 16. A post 18 is illustrated as embedded in the earth 20. The ram 14 is supported on the frame 12. The ram 14 includes a piston 22 extending outwardly therefrom. The ram 14 is suitable for moving the piston 22 from a retracted position to an extended position (such as shown in FIG. 1). The chain 18 is affixed to the top end 24 of the piston 22. The chain 16 wraps around the post 18. The ram 14 serves to push the piston 22 and the chain 16 upwardly so as to extract the post 18 from the earth 20.

In the present invention, the frame 12 includes a housing 26 positioned adjacent to the top surface of the earth 20. The ram 14 is pivotally connected at 28 to the housing 26. In particular, the ram 14 is affixed to a plate 30 which includes a support tube mounted onto an axle at pivot point 28. A small cleat 32 is affixed to the forward end of the housing 26 so as to engage the earth 20 and to provide resistance to any forward on rearward movement by the frame 12 during the extracting of the post 18 from the earth 20. The frame 12 also has a handle 34 extending generally vertically upwardly therefrom. A pair of wheels 36 are affixed to the handle 34 adjacent to the rear end of the housing 26 so as to allow for portability of the present invention.

Figure 2:
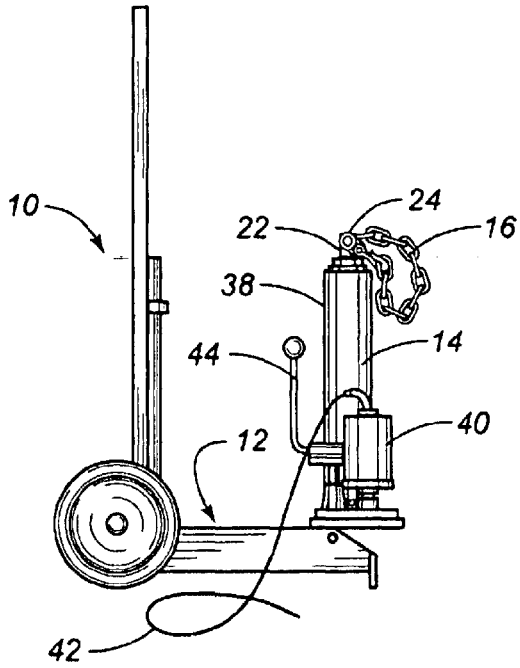
FIG. 2 is a side elevational view showing the fence post extractor with the ram in a vertical orientation.

In normal use, the ram 14 is pivotable between a position offset from a vertical orientation (such as that shown in FIG. 1) to a position having a vertical orientation (such as shown in FIG. 2). The ram 14 includes a cylinder 38 affixed to the plate 30 and extending upwardly therefrom. The piston 22 extends outwardly of a top of the cylinder 38. The chain 16 is attached to the top of the piston 22.

FIG. 2 is an illustration of the post extracting device 10 of the present invention with the ram 14 in its vertical orientation. In FIG. 2, it can be seen that the post 18 has been removed from connection with the ram 14. The piston 22 is illustrated as retracted back into the cylinder 38. The chain 16 is secured to the top 24 of the piston 22. In particular, in FIG. 2, it can be seen that an actuator 14 is associated with the cylinder 38 so as to provide the pneumatic or hydraulic actuation for the movement of the piston 22 outwardly of the cylinder 38. The actuator 40 can be properly actuated by fluid passing through fluid line 42 into the interior of the actuator 40 or by manual action on manual pump 44. In the position shown in FIG. 2, the device 10 can suitably be transported from position to position. When the ram 14 is angled outwardly, such as shown in FIG. 1, the device is in a proper position for the lifting of the post 18. The angled relationship between the ram 14 and the post 18 provides maximum lifting capabilities for the extraction of the post 18. Because of the close relationship between the plate 30 and the surface of the earth 20, the ram 14 will be distributing its forces upon the earth 20 and not upon the housing 26.

Figure 3:
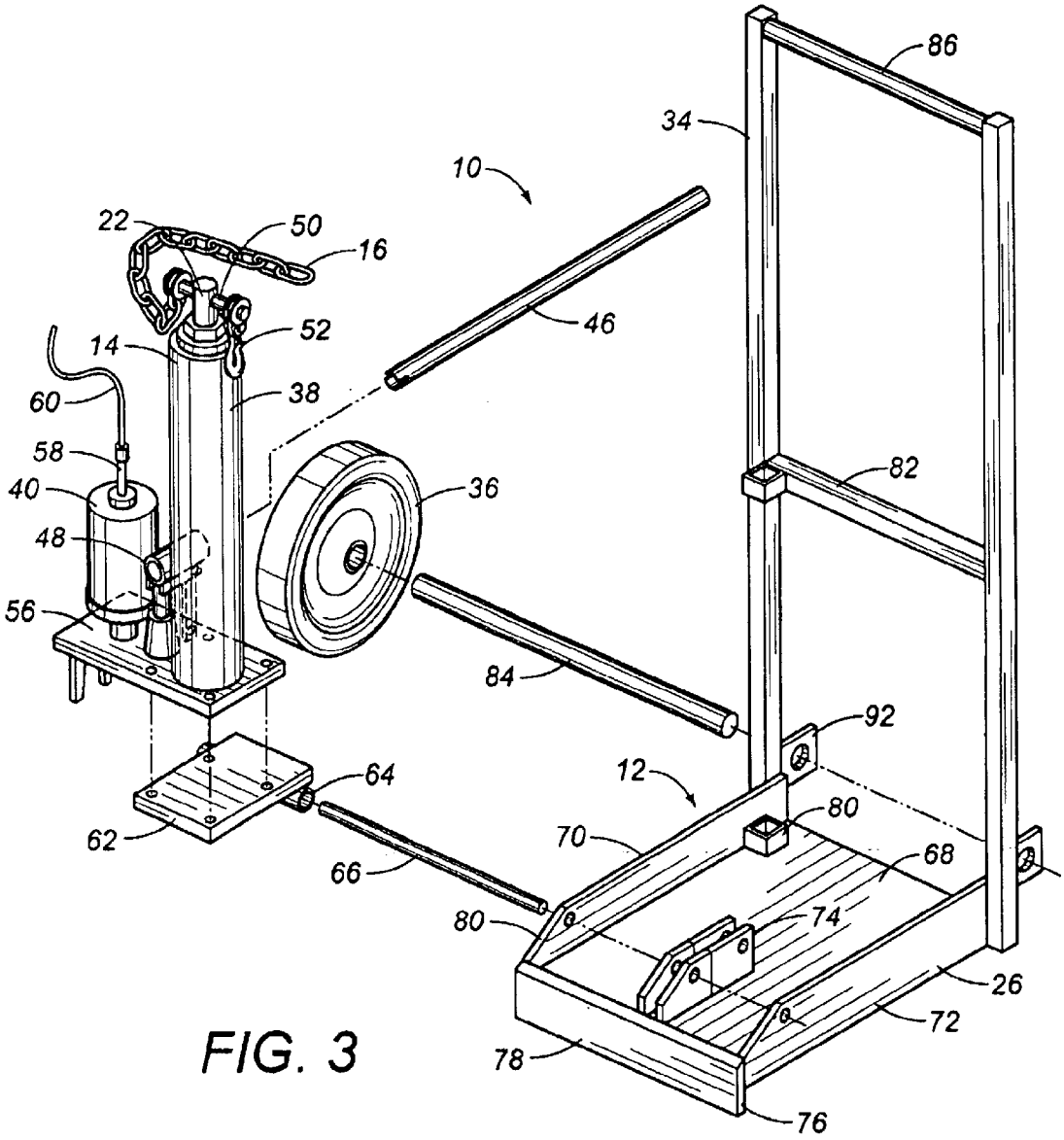
FIG. 3 is an exploded view of the fence post extractor in accordance with the preferred embodiment of the present invention.

FIG. 3 shows an exploded view of the extracting device 10 in accordance with the teaching of the present invention. In particular, it can be seen that the ram 14 is in the form of a hydraulic cylinder. A rod 46 can be connected to a lever arm 48 associated with the cylinder 38 for the manual actuation and operation of the ram 14. The piston 22 is illustrated as extending outwardly from the top of the cylinder 38. Piston 22 has a cross bar 50 extending thereacross. A hook 52 is affixed to one end of the cross bar 50 and the chain 16 is affixed to the opposite end of the cross bar 50. When the chain 16 is wrapped around a post, the end 54 of chain 16 can be affixed to the hook 52 for secure attachment.

The actuator 40 is also positioned on a base plate 56. Actuator 40 includes a connector 58 for attachment to an air hose 60. As such, external air can be used so as to actuate the cylinder 38 for the movement of the piston 22 between its retracted and its extended positions.

As can be seen in FIG. 3, the base plate 56 has suitable holes for connection to the rotating plate 62. The rotating plate 62 has a rotating plate tube 64 affixed to an underside thereof. An axle 66 is positioned through the rotating plate tube so as to allow for the rotatable movement of the plate 62.

Housing 26 of frame 12 is in the form of a I-beam. This I-beam shaped housing 26 includes a central area 68 with a first side plate 70 and a second side plate 72 extending upwardly on opposite sides of the central area 64. Suitable holes are formed on the side plates of 70 and 72 for the receipt of axle 66 in rotatable relationship therein. A stop member 74 is affixed to the central area 68 behind the axle 66. A cleat 76 is affixed to the forward edge of the I-beam-shaped housing 26. It can been seen that cleat 76 has a bottom portion 78 which can be engaged into the earth at the forward end of frame 12. A bottom storage ring 80 is also formed in the central area 68 generally adjacent the rearward end of the housing 26.

It is important to note that each of the side plates 70 and 72 has a tapered forward edge 80. The pivotal movement of the plate 62 with respect to these angled forward surfaces 80 allows the ram 14 to assume the position shown in FIG. 1. The stop 74 allows the ram 14 to assume its vertical orientation, such as shown in FIG. 2.

The handle 34 extends upwardly from the rear of the housing 26. A cross support 82 can be affixed to each of the bars associated with handle 34 for extra structural support. An axle 84 will be received by the axle supports associated with the handle 34 so as to allow for the attachment of wheels 36 thereto. The handle 34 also has a handle assembly 86 secured to an upper end thereof.

Figure 4:
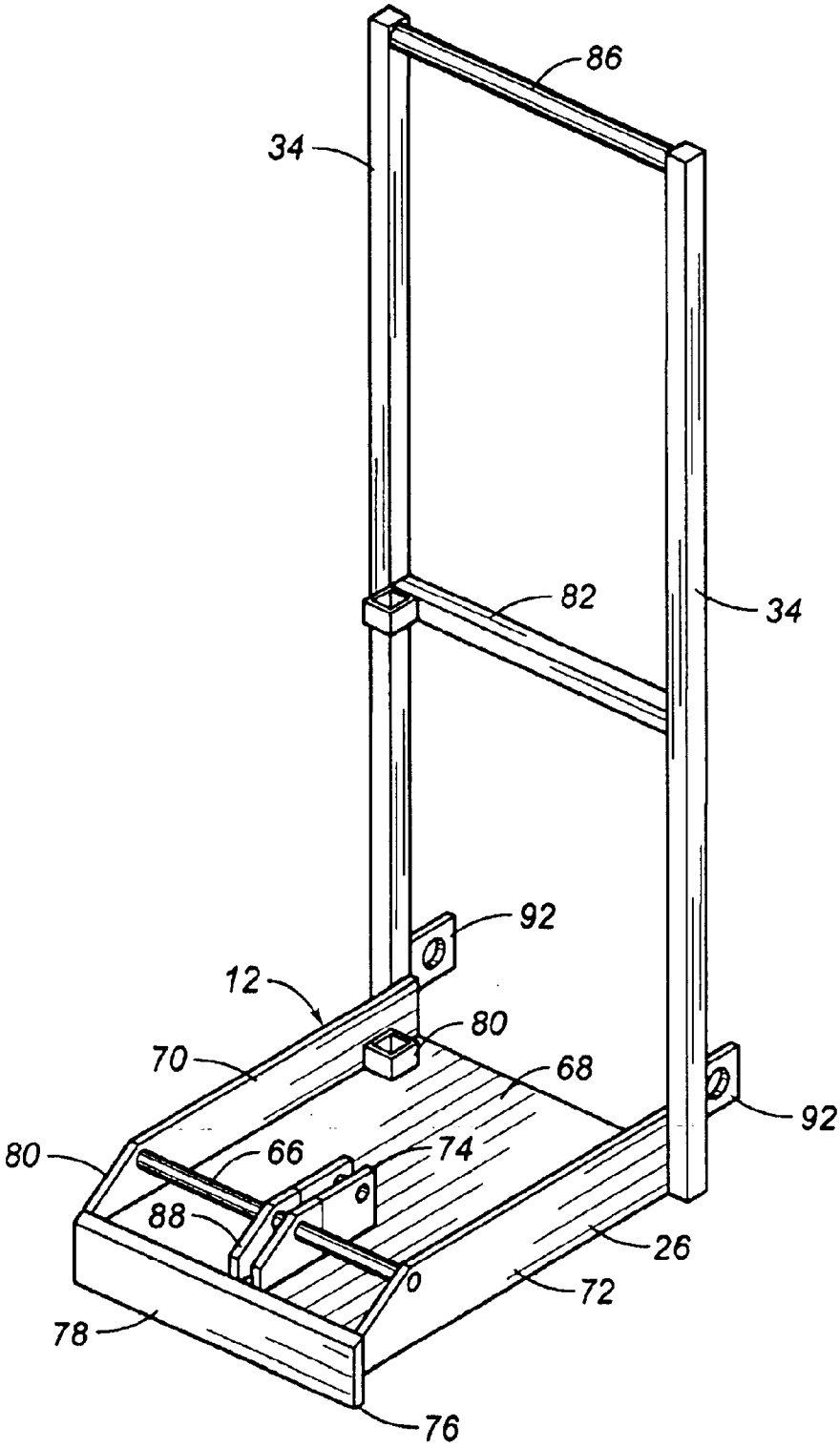
FIG. 4 is a detailed isolated view of the frame associated with the fence post extractor of the present invention.

Referring to FIG. 4, the particular configuration of the housing 26 is illustrated. Housing 26 is illustrated as having side plates 70 and 72 on opposite sides of the central area 68. The axle 66 extends across the central area 68 and is received by the holes in each of the side plates 70 and 72. A central structure 88 is provided in the central area 68 and is also associated with the stop 74. It can be seen that each of the side plates 70 and 72 has a downwardly tapered forward edge 80. The cleat 76 is attached to the forward edge of the housing 26. The upwardly extending rods of handle 34 are formed at the back of the housing 26. Axle support structures 92 are holes formed in flanges extending outwardly from each of the rods 34.

Figure 5:
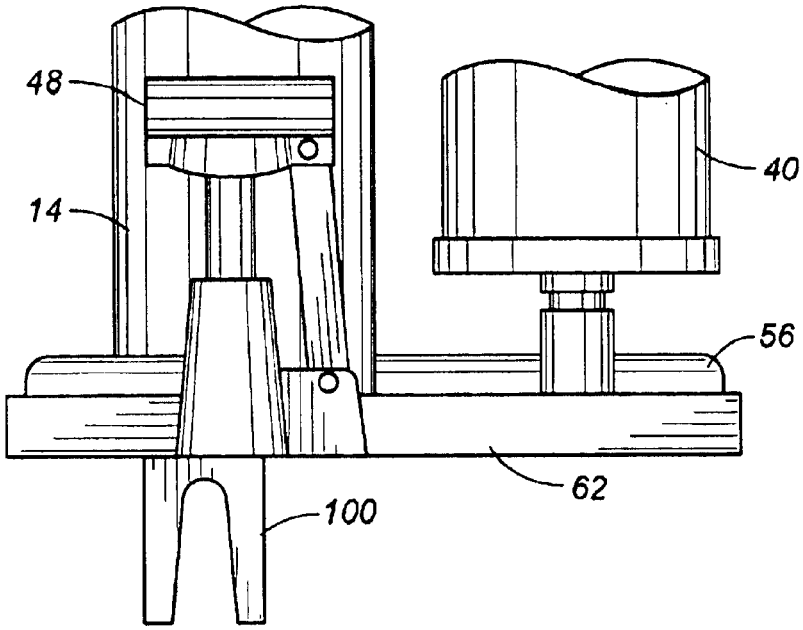
FIG. 5 is a detailed view showing the configuration of the support plate for the ram and the actuator of the present invention.

FIG. 5 shows the structure of the rotating plate assembly 62 as affixed to the base plate 56 associated with the ram 14. It can be seen that the actuator 40 is fluidically attached to the hydraulics lines extending through the base plate 56. Similarly, the manual lever 48 is illustrated for the manual pumping and actuation of the piston 22 of rod 14. Importantly, a slotted connector 100 is affixed to the bottom of the rotating plates 62. This slotted connector 100 allows for engagement with the rotating tube 66 so as to allow the ram 14 to be movable between its vertical orientation and its orientation offset to the vertical axis.

Figure 6:
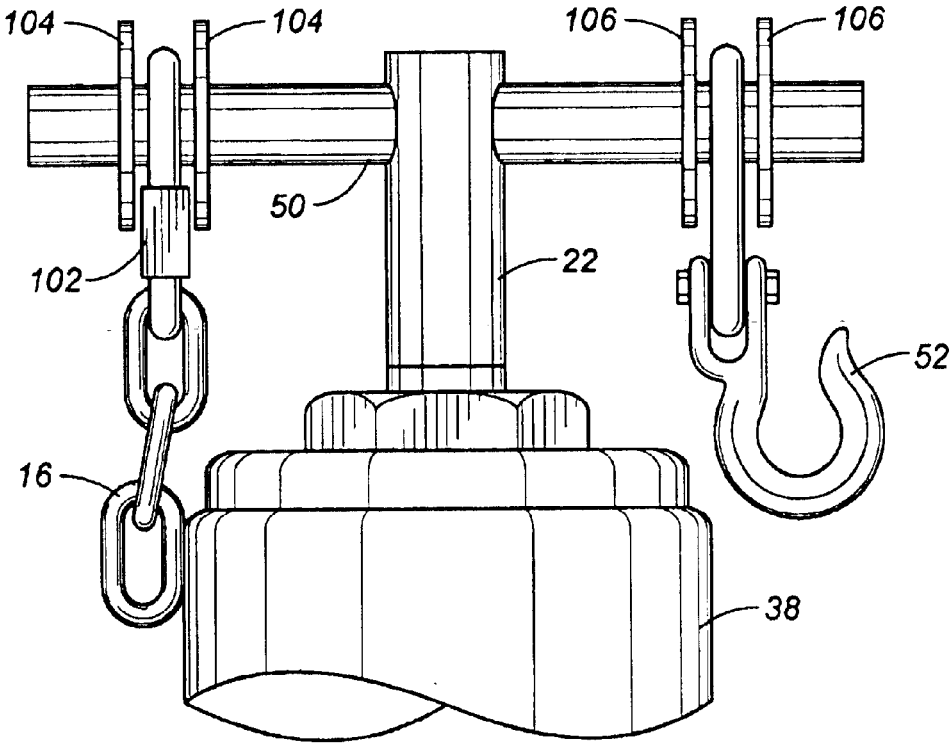
FIG. 6 is detailed end view showing the top of the piston of the ram and its associated chain and hook assembly.

FIG. 6 shows a top view of the piston 22 in its retracted position with respect to the cylinder 38. The cross bar 50 is particularly illustrated as affixed to the top end of the piston 22. A hook 52 is attached to the cross bar 50 on one side of the piston 22. Similarly, the chain 16 is attached to a suitable shackle 102 secured to the opposite end of the cross bar 50. Protective sleeves 104 are positioned on opposite sides of the shackle 102 on the cross bar 50. Additionally, protective sleeves 106 are affixed to the cross bar 50 around the connection of the hook 52 with the cross bar 50.

In normal use, the device 10 can be rolled to a desired location, such as a post extracting device 10 or a sign that has been concreted into the ground. The device 10 is placed as close as possible to the post 18 and the ram 14 is rotated over to a position adjacent to the post 18. The rotating plate and the hydraulic assembly is now resting against the ground cleat and the distal end of the ram is against the post. The chain is wrapped around the post and secured to the chain hook. An air hose is attached and the ram is actuated so as to extend the piston from the cylinder. As pressure increases, the ground cleat will dig into the earth or against the pavement so as to further stabilize the device 10. The post or sign is pulled from the earth 20 with or without the concrete plug attached. If there is no concrete plug, then the post is simply pulled out of the ground. The present invention does not completely pull the post to where it is no longer in contact with the ground. The post is simply broken from the ground and pulled up sufficiently loose and easily removed by lifting, prying or by some minor digging. The post can then be hauled away or disposed of. The wheels that are attached to the wheel axle are even with the ground when the I-beam assembly is resting horizontally on the earth. As a result, no weight or pressure from the pulling process is imparted upon the wheel or relies upon the action of the wheels. When the unit is leaned back with the handle, the wheels engage the ground and the unit is easily rolled to the next location. The cross support between the side arms adds extra support and provides an attachment point for the top storage ring which allows for storage of the manual hydraulic handle that extends down through it to the bottom storage ring.

In the preferred embodiment of the present invention, the ram is either air or manually operated. It is ideally an eight ton ram jack. The eight tons of force, as applied directly to a post, is sufficient so as to extract virtually all fence posts, street signs or related posts structures from the earth.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A post extracting device comprising:

a frame;

a ram means supported on said frame, said ram means having a piston extending outwardly therefrom, said ram means for moving said piston from a retracted position to an extended position; and a post gripping means connected to said piston, said post gripping means for wrapping around the post, said ram means for pushing said post gripping means upwardly so as to extract the post from the earth, said frame comprising:

an I-beam structure having a central area with side plates extending longitudinally on opposite sides of said central area; and a plate rotatably mounted to said side plates, said ram means being affixed to said plate.

2. The device of claim 1, said ram means being pivotally mounted on said frame so as to be movable between a vertical orientation to a position angularly offset from the vertical orientation.

3. The device of claim 2, said ram means comprising:

a cylinder having a bottom affixed to said frame, said piston extending outwardly of a top of said cylinder, said post gripping means affixed to a top of said piston; and an actuator connected to said cylinder so as to move said piston from said retracted position to said outwardly extending position.

4. The device of claim 1, said I-beam structure having an angled forward surface, said plate being rotatable so as to be positioned upon said angled forward surface so as to cause said ram means to tilt outwardly from said frame.

5. The device of claim 4, further comprising:

a cleat affixed to a forward edge of said angled forward surface, said cleat having a bottom earth-engaging edge.

6. The device of claim 4, said I-beam structure having a stop member positioned in said central area so as to support said plate in said vertical orientation.

7. The device of claim 1, further comprising:

a handle affixed to a rear of said I-beam structure, said handle extending upwardly therefrom.

8. The device of claim 7, further comprising:

an axle affixed to said handle toward a rear of said I-beam structure; and a pair of wheels rotatably mounted respectively to opposite ends of said axle.

9. A post extracting device comprising:

a frame;

a ram means supported on said frame, said ram means having a piston extending outwardly therefrom, said ram means for moving said piston from a retracted position to an extended position; and a post gripping means connected to said piston, said post gripping means for wrapping around the post, said ram means for pushing said post gripping means upwardly so as to extract the post from the earth, said piston having a cross bar extending transversely thereacross, said post gripping means comprising:

a hook affixed to one end of said cross bar; and a chain having one end affixed to another end of said cross bar, said chain having a portion securable to said hook.

10. A post extracting device comprising:

a frame;

a ram means pivotally mounted to said frame and movable between a vertical orientation and an orientation angularly offset from vertical; and a flexible member affixed to an upper end of said ram means, said ram means for pushing said flexible member upwardly when said ram means is in said orientation angularly offset from vertical, said flexible member having a length suitable for extending around the post, said frame comprising:

a housing having a central area and side plates extending respectively upwardly on opposite sides of said central area, said ram means being affixed to a plate rotatably mounted on said housing.

11. The device of claim 10, said ram means comprising:

a cylinder pivotally affixed to said frame;

a piston slidably received within said cylinder, said flexible member affixed to an end of said piston extending outwardly of said cylinder; and an actuator connected to said cylinder so as to cause said piston to move forcibly outwardly of said cylinder.

12. The device of claim 11, said actuator having a pneumatic actuator.

13. The device of claim 10, each of said side plates of said housing having a downwardly tapered forward edge, said forward edge supporting said plate when said ram means is in said orientation angularly offset from vertical.

14. The device of claim 10, said frame further comprising:

a cleat affixed to a forward edge of said housing, said cleat having a surface extending vertically downwardly below a bottom of said housing.

15. The device of claim 10, said frame further comprising:

a handle extending upwardly from a rear end of said housing; and a pair of wheels rotatably mounted to said handle or to said housing, said pair of wheels having a bottom surface positioned below a bottom of said housing.

* * * * *